US006227927B1

(12) United States Patent
Smith

(10) Patent No.: US 6,227,927 B1
(45) Date of Patent: May 8, 2001

(54) SOUND PRODUCING DEVICE

(76) Inventor: Frank T. Smith, 200 Rocky Knob La., Nederland, CO (US) 80466

( * ) Notice: Subject to any disclaimer, the term of this patent is extended or adjusted under 35 U.S.C. 154(b) by 0 days.

(21) Appl. No.: 09/634,357

(22) Filed: Aug. 9, 2000

(51) Int. Cl.[7] ..... A63H 5/00
(52) U.S. Cl. ..... 446/192; 446/213; 446/397
(58) Field of Search ..... 446/188, 192, 446/213, 397

(56) References Cited

U.S. PATENT DOCUMENTS

| | | | | |
|---|---|---|---|---|
| 1,537,218 | * | 5/1925 | Bartolowsky | 446/192 |
| 1,805,566 | * | 5/1931 | Cipra | 446/192 |
| 2,904,931 | * | 9/1959 | Hanf | 446/188 |
| 4,179,845 | * | 12/1979 | Jacob | 446/188 |
| 4,279,100 | * | 7/1981 | Rivette et al. | 446/192 |
| 6,048,250 | * | 4/2000 | Hudson | 446/397 X |

* cited by examiner

*Primary Examiner*—John A. Ricci

(57) ABSTRACT

A sound producing device comprises an outer tube having an open end and a closed end, a plunger which fits inside the open end of the outer tube, and an amount of flexile material arranged between an outer surface of the plunger and an inner surface of the outer tube when the plunger is inserted in the outer tube. Movement of the plunger within the outer tube creates a pressure or vacuum, forcing air past the flexile material and thereby creating an amusing sound. The movement may also create an entertaining visual effect if the outer tube is made of a transparent material. The device may be configured to include a guided plunger having a longitudinal guide shaft therethrough which is adapted to receive a centering guide pin associated with the outer tube. Other embodiments may incorporate multiple tubes to produce distinctly different amusing sounds, or a sound enhancer tube to produce an amusing sound with richer tone.

7 Claims, 7 Drawing Sheets

SOUND PRODUCING DEVICE

FIELD OF THE INVENTION

The present invention relates to sound producing devices and more particularly to sound producing devices having an air driven sound generating system.

BACKGROUND OF THE INVENTION

Over the years, there has been a multitude of air driven sound inventions, resulting in a great variety of unusual sounds. Some of these inventions have been specifically designed to entertain and amuse the users of these devices.

For example, U.S. Pat. No. 5,522,756 issued to Barthold discloses an AIR DRIVEN SOUND GENERATING TOY USING MALLEABLE MATERIAL. The sound generating toy has a bellows used for producing a flow of pressurized air through a curved tube containing a malleable material. The air is forced past the malleable material causing an entertaining sound.

Despite the advances provided by the above-noted devices, a continuing need exists for better sound producing devices.

SUMMARY OF THE INVENTION

It is the object of the present invention to create a simple, portable sound producing device for the amusement of the user and others.

A first illustrative embodiment of the present invention is a sound producing device comprising an outer tube having an open end and a closed end, a plunger which fits inside the open end of the outer tube, and an amount of flexile material arranged between an outer surface of the plunger and an inner surface of the outer tube when the plunger is inserted into the outer tube. Movement of the plunger within the outer tube creates a pressure or vacuum, forcing air past the flexile material and thereby creating an amusing sound. The movement may also create an entertaining visual effect if the outer tube is made of a transparent material.

Another embodiment of the invention incorporating a guided plunger offers a more reliable way of producing the amusing sound by use of a centering guide pin.

A further embodiment of the invention incorporating multiple tubes can produce distinctly different amusing sounds.

Yet another embodiment of the invention incorporating a sound enhancer tube produces an amusing sound with richer tone.

BRIEF DESCRIPTION OF THE DRAWINGS

The above and other objects and advantages of the present invention will become apparent from the following description when read in conjunction with the accompanying drawings.

DETAILED DESCRIPTION OF THE PREFERRED EMBODIMENTS

Figure 1:
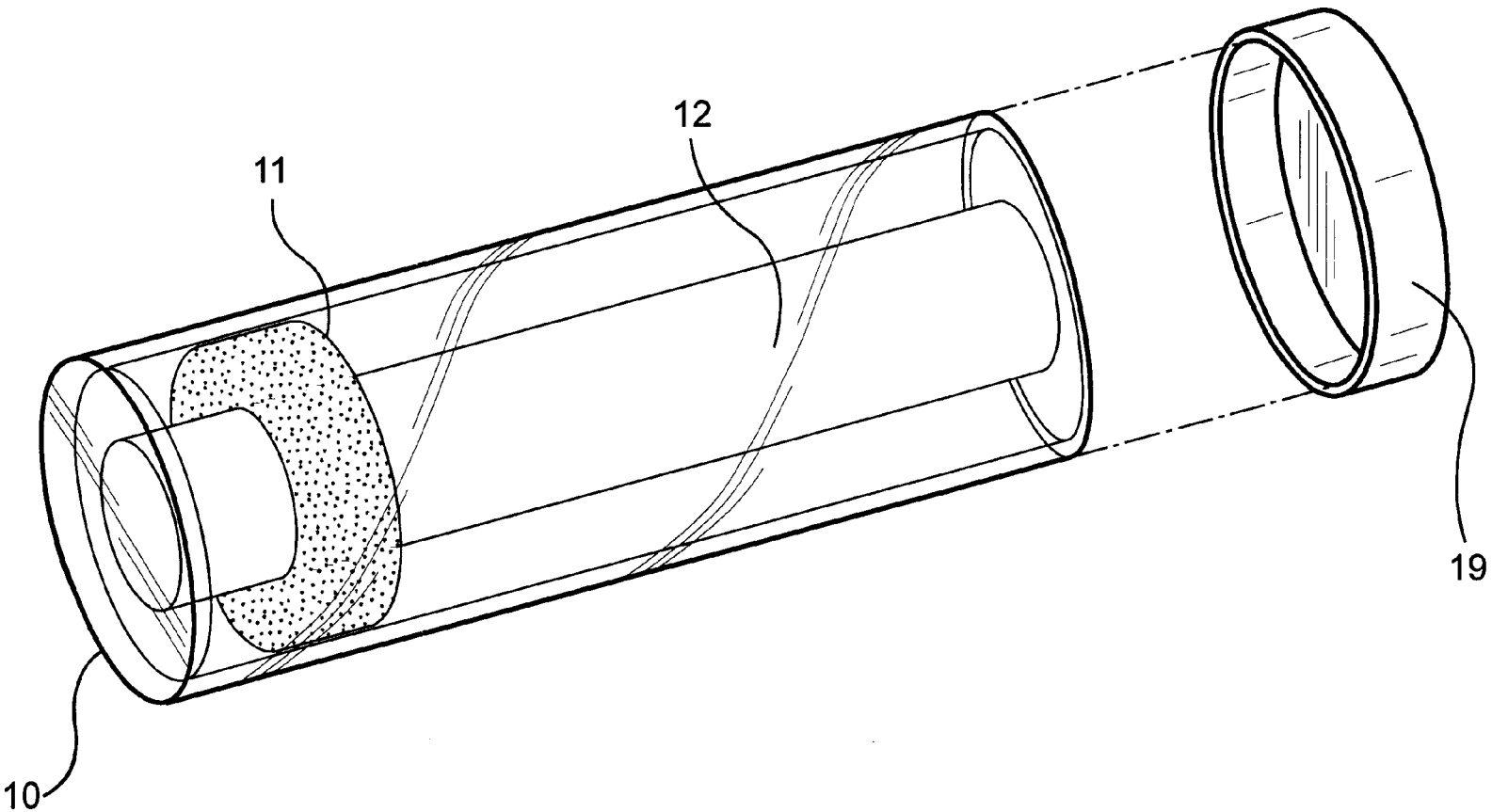
FIG. 1 shows a first illustrative embodiment of the invention.

The present invention in a first illustrative embodiment shown in FIG. 1 is a sound producing device comprising a stiff, hollow outer tube 10, closed at one end, open at the other. The outer tube 10 is preferably clear, i.e., made of a transparent material so that a user can view what is happening inside the outer tube. As shown in FIG. 1, a plunger 12, which may be, e.g., a solid rod or a hollow tube closed at both ends, fits inside the outer tube 10 to form an inner and outer assembly.

An amount of flexile material 11 lies outside of the plunger 12 and inside of the outer tube 10. The amount of flexile material 11 required in a given implementation of the invention will generally vary depending upon the dimensions of the outer tube 10 and plunger 12, but may be on the order of four ounces in one possible example. The flexile material may be a material of the type known as GAK and available from Mattel Inc. of El Segundo, Calif., or may be any of a number of other materials capable of producing amusing sounds when configured as shown in FIG. 1, e.g., well-known commercially available play materials such as Gooze, Slime, etc.

A cap 19 fits on the open end of the outer tube 10 and is used to keep the flexile material 11 from drying out during storage. The cap 19 is to be removed during operation of the sound producing device.

Figure 2:
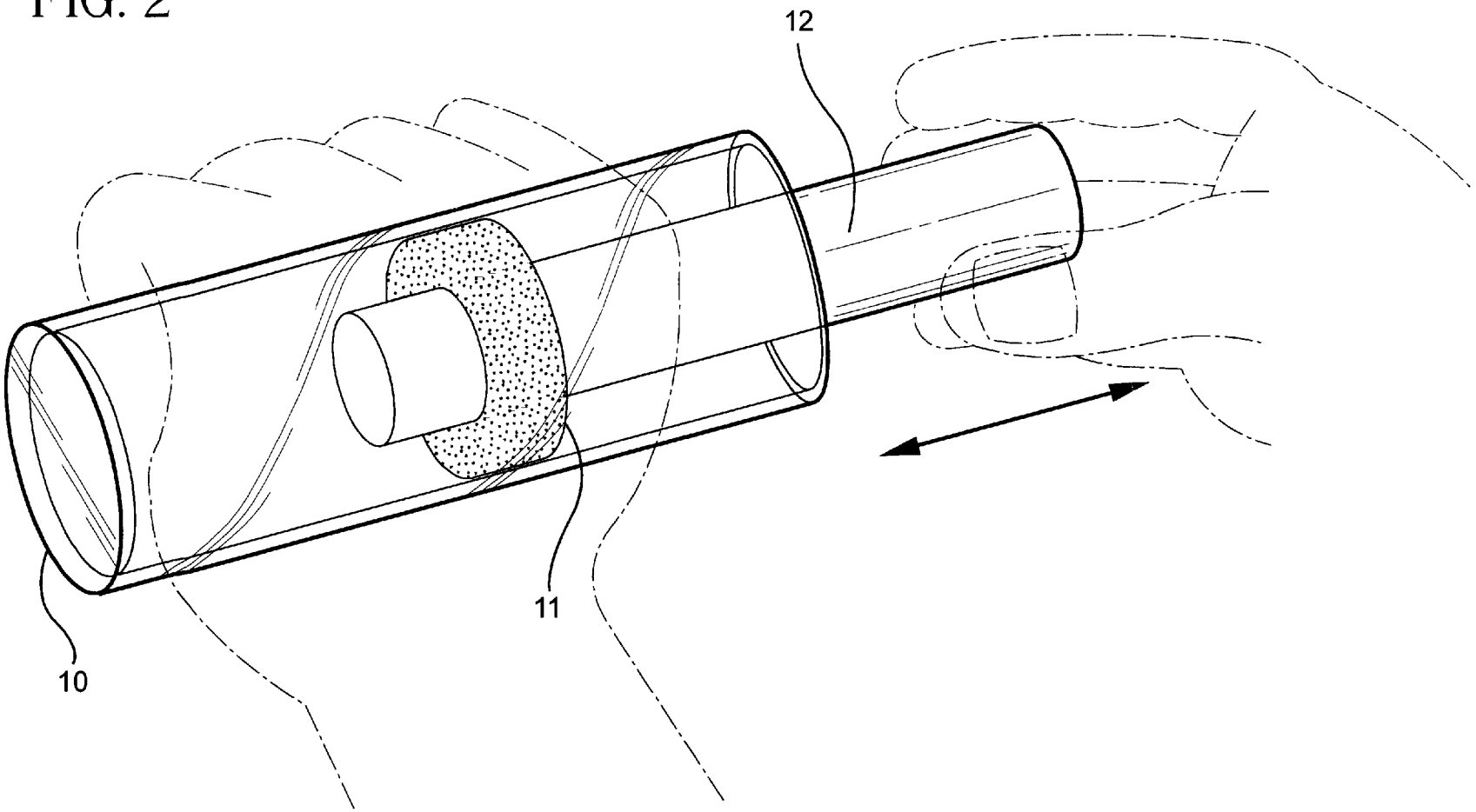
FIG. 2 shows the operation of the first embodiment.

In operation, starting with the plunger 12 near the open end of the outer tube 10 and the flexile material 11 positioned as shown in FIG. 2, the plunger 12 is slowly pushed towards the closed end of the outer tube 10. A small pressure is created by this action in the closed end of the outer tube 10, which causes the pressurized air to move toward the open end of the outer tube 10. The pressurized air is forced past the flexile material 11 causing an amusing sound and an interesting visual effect. Once the plunger 12 is pushed all of the way into the outer tube 10, the plunger 12 is slowly pulled out of the outer tube 10. A small vacuum is created by this action in the closed end of the outer tube 10, which causes air to be pulled into the resulting chamber, again causing an amusing sound. Repetition of this back and forth motion will cause repeated amusing sounds.

As noted previously, the dimensions of the outer tube 10 and plunger 12 may vary depending on the particular implementation. In an example of one such implementation, the outer tube 10 may have an inner diameter of 1.5 inches (3.81 cm), a length of 16 inches (40.64 cm), and a material thickness of 0.10 inch (0.25 cm), the plunger 12 may have an outer diameter of 1.1 inch (2.79 cm) and a length of 16 inches (40.64 cm), and the cap 19 may have an inner diameter of 1.7 inch (4.32 cm) and a length of 1 inch (2.54 cm).

As will be described in detail below, altering the dimensions of the outer tube 10 and plunger 12 or the characteristics of the flexile material 11 can alter a characteristic of the sound produced by the device.

For example, decreasing the diameter of the plunger 12 with respect to the outer tube 10 diameter will generally require a larger amount of the flexile material 11 due to the increased volume created between the outer tube 10 and the plunger 12. Also, the amusing sound created by the back and forth motion of the plunger 12 will have a lower resonant frequency, and thus a deeper tone. Conversely, increasing the diameter of the plunger 12 with respect to the outer tube 10 inner diameter will generally require a smaller amount of the flexile material 11 due to the resulting smaller volume created between the plunger 12 and the outer tube 10. Also, the amusing sound created by the back and forth motion of the plunger 12 will have a higher resonant frequency, and thus an elevated tone.

As another example, increasing the lengths of the outer tube 10 and the plunger 12 together will cause an increase in the "sounding tube" length. This will cause the device to resonate at a lower frequency, thus resulting in an amusing sound with a deeper tone. Conversely, decreasing the lengths of both the outer tube 10 and the plunger 12 will cause a decrease in the "sounding tube" length. This will cause the device to resonate at a higher frequency, thus resulting in an amusing sound with an elevated tone.

As yet another example, increasing the viscosity of the flexile material 11 will generally cause an increase in the size of the air bubbles passing through the flexile material. This effect will cause an amusing sound with a deeper tone. Conversely, decreasing the viscosity of the flexile material 11 will generally cause a decrease in the size of the air bubbles passing through the flexile material 11. This effect will cause an amusing sound with an elevated tone.

Figure 3:
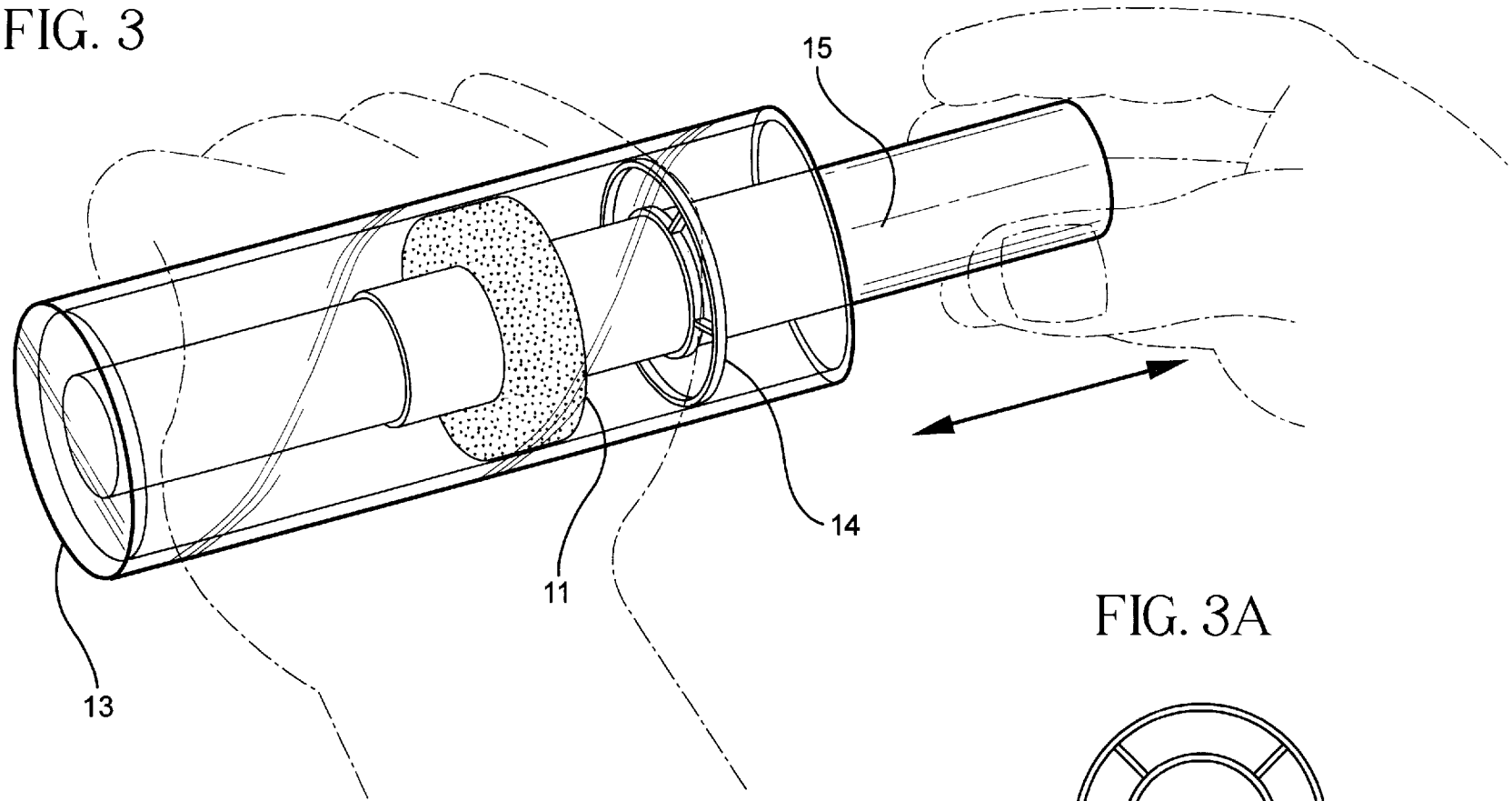
FIG. 3 shows an embodiment of the invention incorporating a guided plunger.
Figure 3A:
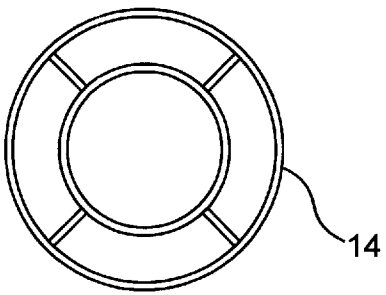

FIG. 3 shows a sound producing device in accordance with another illustrative embodiment of the invention. This embodiment of the invention comprises an outer tube with guide pin 13, a plunger with hollow guide shaft 15, a guide plate 14, and the flexile material 11. An advantage of this embodiment of the invention is that the plunger with hollow guide shaft 15 will not be allowed to travel near the inside wall of the outer tube with guide pin 13. The plunger with hollow guide shaft 15 will instead only be allowed to travel in the center dimension of the outer tube with guide pin 13. This restricted movement of the plunger with hollow guide shaft 15 forces all of the pressurized air to pass through the flexile material 11. Otherwise, if the plunger with hollow guide shaft 15 was allowed to travel near the inside of the outer tube with guide pin 13, it may allow the pressurized air to escape around the flexile material 11 diminishing the quality of the intended amusing sound.

The outer tube with guide pin 13 is similar to the outer tube 10 depicted in FIGS. 1 and 2. Element 13 in one possible implementation incorporates a 0.25 inch (0.635 cm) diameter guide pin made to fit exactly inside the plunger with hollow guide shaft 15. The plunger with hollow guide shaft 15 thus has a corresponding approximately 0.25 inch (0.635 cm) guide shaft bored through the center thereof. Of course, other dimensions may be used, as required for a given implementation.

The guide plate 14 in this illustrative embodiment is a piece made up of an outer circle which adheres to the inside of the tube with guide pin 13 and an inner circle which has a slightly larger diameter than the plunger with hollow guide shaft 15. The inner circle and the outer circle of the guide plate 14 are connected by at least three radial connecting rods. The connecting rods are designed to firmly attach the inner circle to the outer circle of the guide plate 14, yet allow air to pass by the guide plate 14.

In operation, the plunger with hollow guide shaft 15 is moved toward the closed end of the outer tube with guide pin 13. A small pressure is created by this action in the closed end of the outer tube with guide pin 13, which causes the pressurized air to move toward the open end of the outer tube with guide pin 13. The pressurized air is forced past the flexile material 11 and guide plate 14, causing an amusing sound and an interesting visual effect. Once the plunger with hollow guide shaft 15 is pushed all of the way into the outer tube with guide pin 13, the plunger with hollow guide shaft 15 is slowly pulled out of the outer tube with guide pin 13. A small vacuum is created by this action in the closed end of the outer tube with guide pin 13, which causes air to be pulled into the resulting chamber, again causing an amusing sound. Repetition of this back and forth motion will cause repeated amusing sounds.

Figure 4:
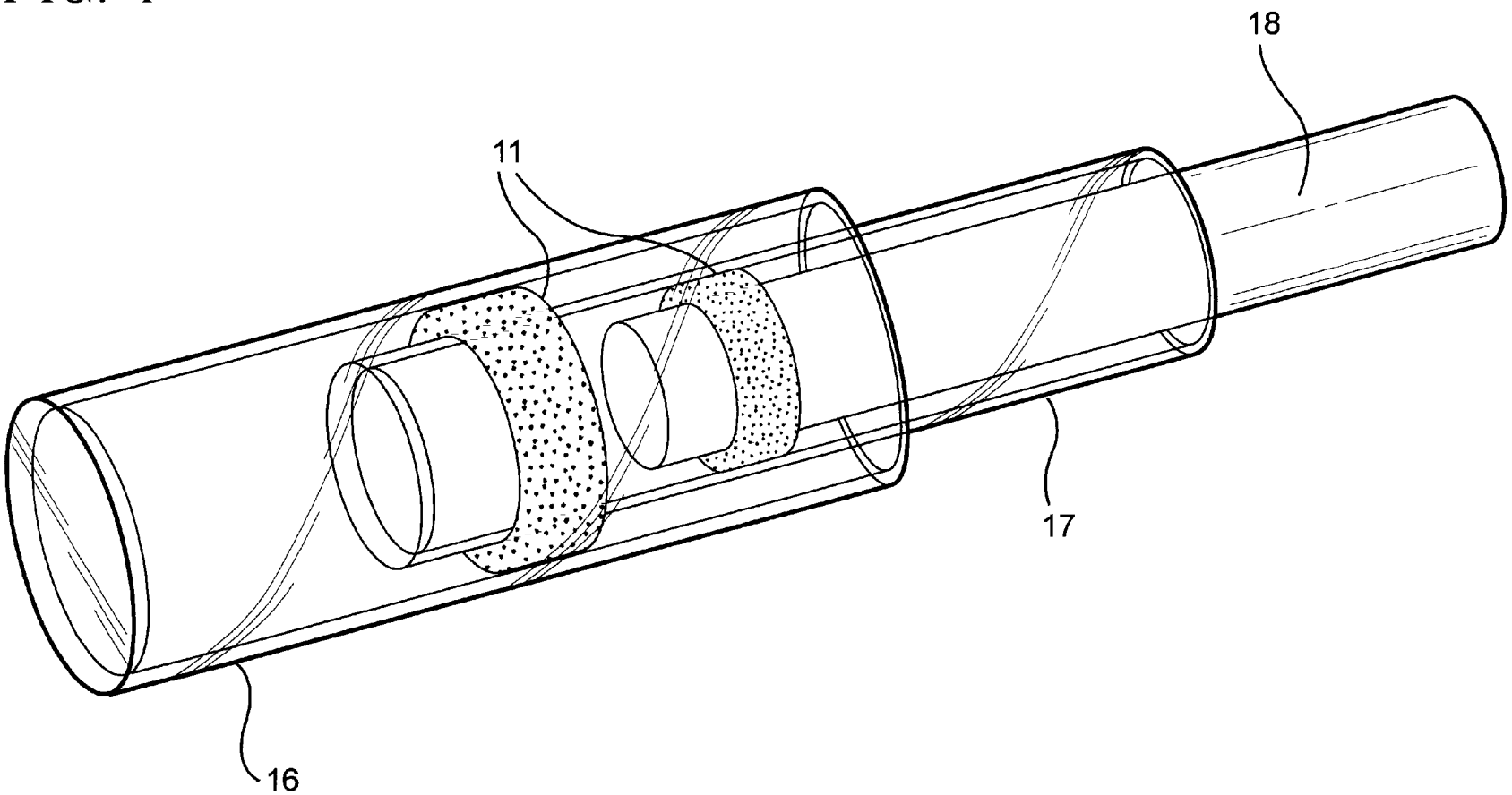
FIG. 4 shows an embodiment of the invention incorporating multiple tubes.

FIG. 4 shows another illustrative embodiment of the invention. This embodiment differs from those previously described in that it uses two sounding tubes to produce two distinctly different amusing sounds. More specifically, FIG. 4 shows a sound producing device comprising an outer tube 16, a middle tube 17, a plunger 18, and the flexile material 11. The plunger 18 is a solid rod or a hollow tube closed at both ends. This plunger 18 fits into the open end of the middle tube 17. The middle tube 17 is a stiff hollow tube closed at one end and open on the other. This middle tube 17 is preferably clear. An amount of flexile material 11 lies outside of the plunger 18 and inside of the middle tube 17. The middle tube 17 fits into the open end of the outer tube 16. An amount of flexile material 11 lies outside of the middle tube 17 and inside of the outer tube 16. The outer tube 16 is a stiff hollow tube closed at one end and open at the other. The outer tube 16 is also preferably clear.

Figure 5:
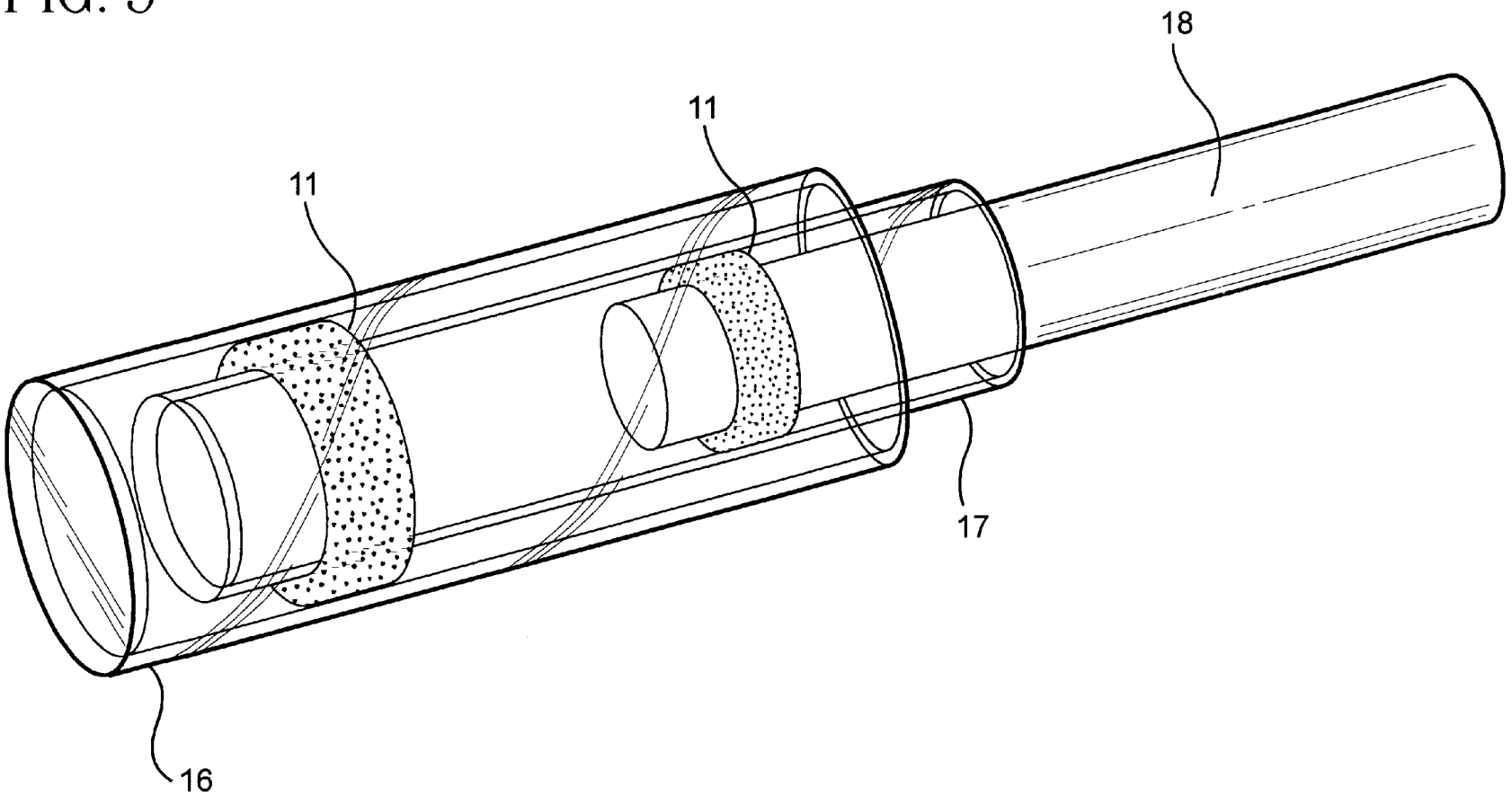
FIGS. 5 and 6 show the operation of the embodiment of the invention incorporating multiple tubes.

Starting with the plunger 18 near the open end of the middle tube 17 and the flexile material 11 positioned as shown in FIG. 5, the plunger 18 is slowly pushed towards the closed end of the middle tube 17. A small pressure is created by this action in the closed end of the middle tube 17, which causes the pressurized air to move toward the open end of the middle tube 17. The pressurized air is forced past the flexile material 11 causing an amusing sound and an interesting visual effect. Once the plunger 18 is pushed all of the way into the middle tube 17, the plunger 18 is slowly pulled out of the middle tube 17. A small vacuum is created by this action in the closed end of the middle tube 17, which causes air to be pulled into the resulting chamber, again causing an amusing sound. Repetition of this back and forth motion will cause repeated amusing sounds.

Figure 6:
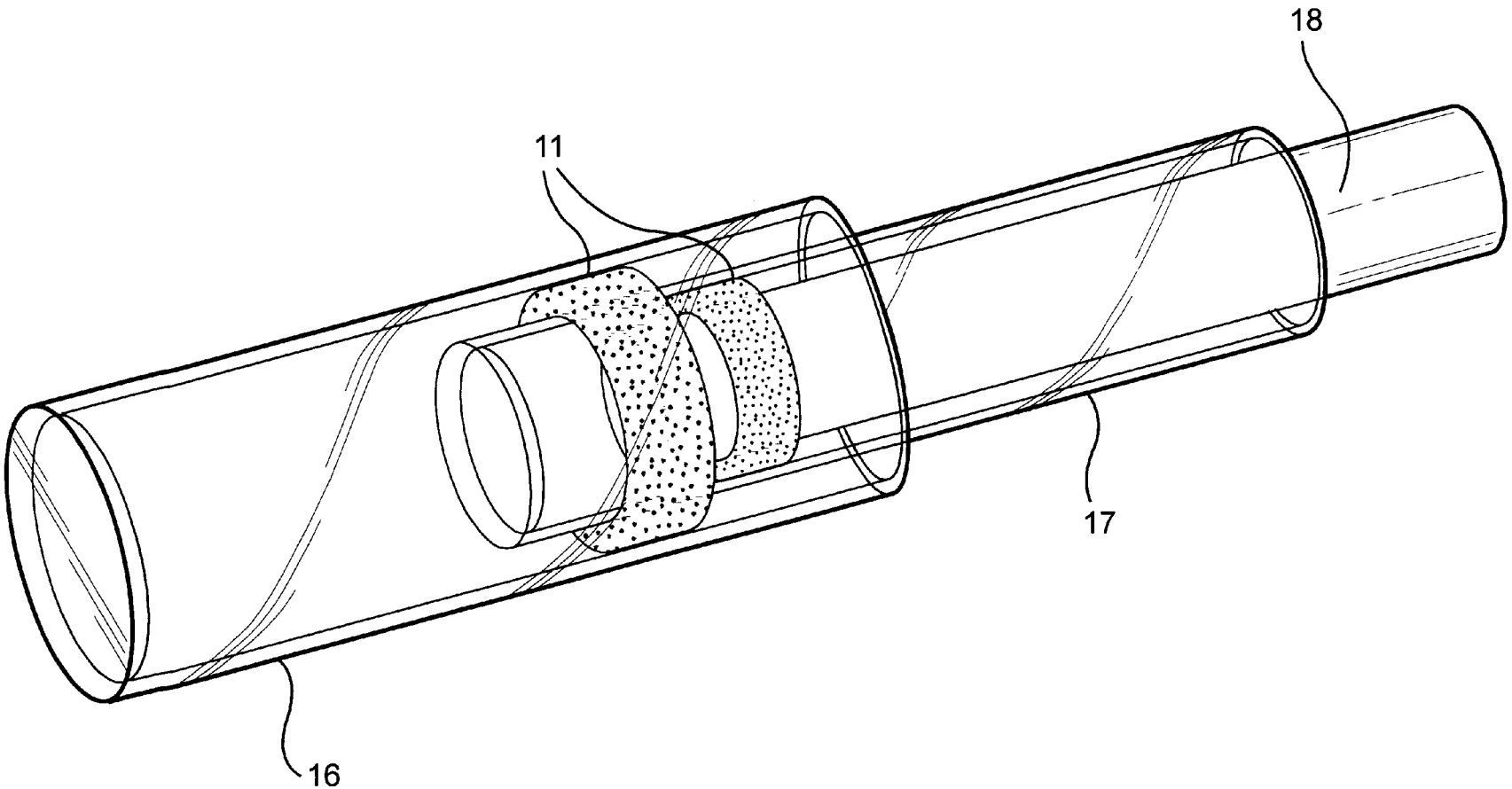

To create amusing sounds using the middle tube 17 and the outer tube 16, a user starts with the middle tube 17 near the open end of the outer tube 16 and the flexile material 11 positioned as depicted in FIG. 6. The middle tube 17 is pushed towards the closed end of the outer tube 16. A small pressure is created by this action in the closed end of the outer tube 16, which causes the pressurized air to move toward the open end of the outer tube 16. The pressurized air is forced past the flexile material 11 causing an amusing sound and an interesting visual effect. Once the middle tube 17 is pushed all of the way into the outer tube 16, the middle tube 17 is then slowly pulled out of the outer tube 16. A small vacuum is created by this action in the closed end of the outer tube 16, which causes air to be pulled into the resulting chamber, again causing an amusing sound. Repetition of this back and forth motion will cause repeated amusing sounds.

As the user acquires some skill in using the multiple tube embodiment of the invention, it will be possible to produce multiple amusing sounds from simultaneous movement of the plunger 18, the middle tube 17 and the outer tube 16.

Figure 7:
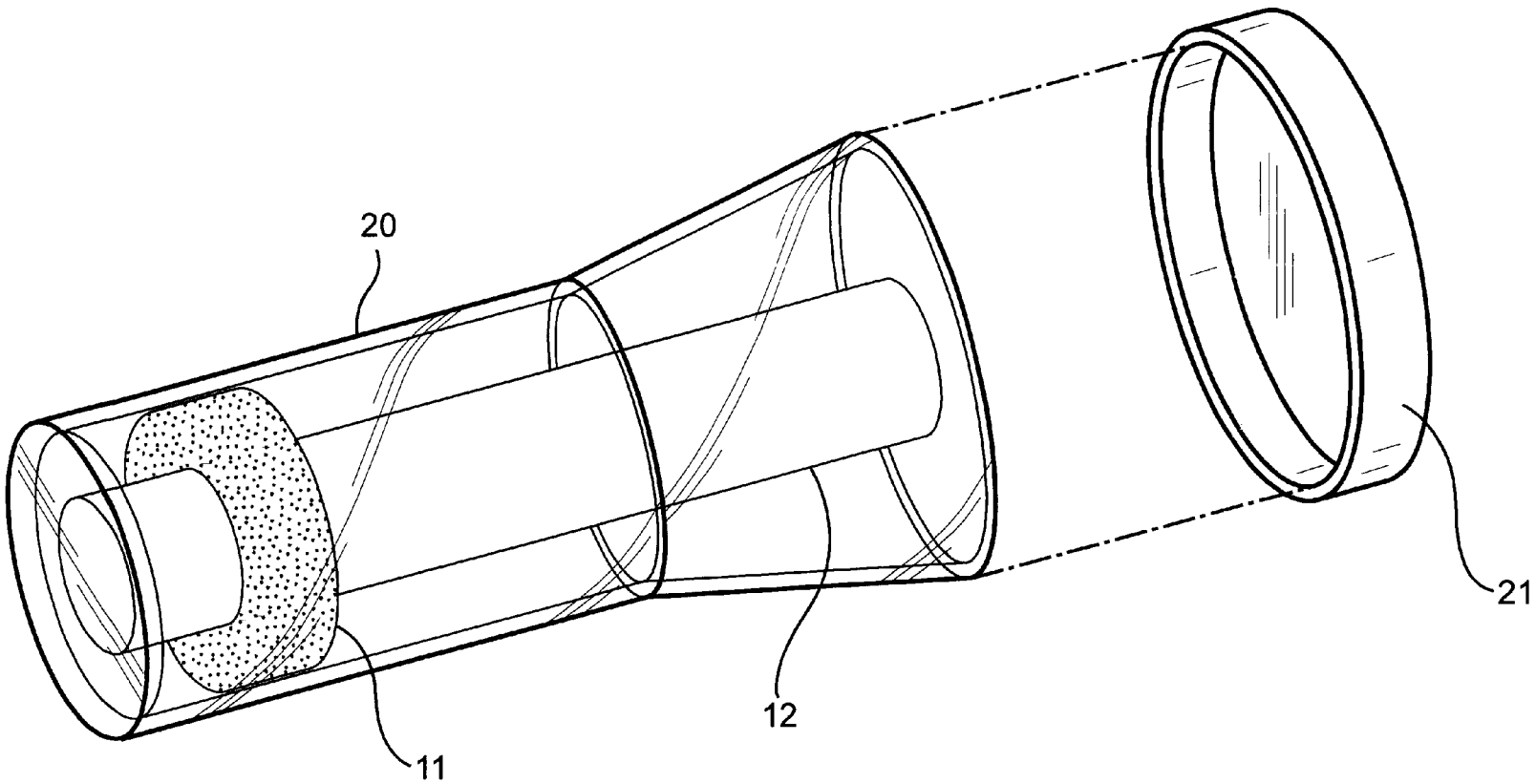
FIG. 7 shows an embodiment of the invention incorporating a sound enhancer tube.

FIG. 7 shows another illustrative embodiment of the invention. This embodiment comprises an outer tube 20, the plunger 12, the flexile material 11, and a cap 21. All parts depicted here are similar to those of the FIG. 1 embodiment except that the outer tube 20 in this embodiment is a sound enhancer flared tube. This flared tube amplifies the air, which escapes the outer tube 20, in a way that makes the amusing sound seem richer and fuller. Operation of the device is the same as that of the device described in conjunction with FIG. 1.

It should be noted that the above-described embodiments are illustrative only, and should not be construed as limiting the present invention to any particular embodiment or group of embodiments. Numerous alternative configurations within the scope of the appended claims will be readily apparent to those skilled in the art.

What is claimed is:

1. A sound producing device comprising:

an outer tube having an open end and a closed end;

a plunger adapted for insertion into the open end of the outer tube; and an amount of flexile material arranged within the outer tube so as to be arranged between an outer surface of the plunger and an inner surface of the outer tube when the plunger is inserted into the outer tube, wherein movement of the plunger within the outer tube forces air past the flexile material to thereby create an amusing sound.

2. The device of claim 1 wherein the outer tube is transparent such that movement of the plunger within the outer tube creates an entertaining visual effect involving the flexile material.

3. The device of claim 1 wherein the closed end of the outer tube is adapted to receive a cap.

4. The device of claim 1 wherein the plunger comprises a guided plunger having a hollow guide shaft longitudinally therethrough, the guide shaft being adapted to receive a corresponding centering guide pin associated with the outer tube.

5. The device of claim 1 wherein a guide plate is arranged within the outer tube so as to surround and support a portion of the plunger.

6. The device of claim 1 further including at least a first middle tube having an open end and a closed end, the plunger being adapted for insertion into the open end of the first middle tube, and the first middle tube being adapted for insertion into the outer tube.

7. The device of claim 1 wherein the outer tube comprises a flared sound enhancer tube.

* * * * *